US011225898B2

(12) United States Patent
Sugiyama et al.

(10) Patent No.: US 11,225,898 B2
(45) Date of Patent: Jan. 18, 2022

(54) VEHICLE

(71) Applicant: TOYOTA JIDOSHA KABUSHIKI KAISHA, Toyota (JP)

(72) Inventors: Koseki Sugiyama, Sunto-gun (JP); Hiroshi Otsuki, Gotemba (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 46 days.

(21) Appl. No.: 16/840,501

(22) Filed: Apr. 6, 2020

(65) Prior Publication Data

US 2020/0386142 A1 Dec. 10, 2020

(30) Foreign Application Priority Data

Jun. 4, 2019 (JP) ..... JP2019-104786

(51) Int. Cl.
*F01N 13/08* (2010.01)

(52) U.S. Cl.
CPC ..... *F01N 13/082* (2013.01); *F01N 2340/02* (2013.01)

(58) Field of Classification Search
CPC .. F01N 2340/02; F01N 13/009; F01N 13/082; F01N 2250/12; F01N 3/08
See application file for complete search history.

(56) References Cited

U.S. PATENT DOCUMENTS 9,103,549 B2 * 8/2015 Galasso ..... C01B 32/50
2013/0186075 A1 * 7/2013 Myers ..... F01N 5/02 60/320
2013/0298761 A1 11/2013 Hamad
2016/0146161 A1 * 5/2016 Sun ..... F01N 3/021 60/598
2017/0306825 A1 10/2017 Kaneeda et al.

FOREIGN PATENT DOCUMENTS

| | | | |
|---|---|---|---|
| DE | 10 2015 119 561 | A1 | 5/2016 |
| EP | 0 878 615 | A2 | 11/1998 |
| JP | 2004-270477 | A | 9/2004 |
| JP | 2005-090426 | A | 4/2005 |
| JP | 2005-327207 | A | 11/2005 |
| JP | 2014-504695 | A | 2/2014 |
| WO | 2016/076041 | A1 | 5/2016 |

OTHER PUBLICATIONS

Sharma, Shivom et al. "Carbon Dioxide Capture From Internal Combustion Engine Exhaust Using Temperature Swing Adsorption" Frontiers in Energy Research, vol. 7, Article 143, pp. 1-12, 2019.

* cited by examiner

*Primary Examiner* — Anthony Ayala Delgado
(74) *Attorney, Agent, or Firm* — Oliff PLC

(57) ABSTRACT

A vehicle comprises an internal combustion engine including an engine body and a catalyst device and a carbon dioxide recovery device recovering carbon dioxide contained in the exhaust is provided. The engine body, catalyst device, and carbon dioxide recovery device are mounted in the vehicle so that relationships X1>X2 and X2>X3 stand where a distance from a mounting position of the engine body to a mounting position of the carbon dioxide recovery device is X1, a distance from a mounting position of the catalyst device to the mounting position of the carbon dioxide recovery device is X2, and a distance from a mounting position of the engine body to a mounting position of the catalyst device is X3.

8 Claims, 4 Drawing Sheets

VEHICLE

FIELD

The present disclosure relates to a vehicle.

BACKGROUND

Japanese Unexamined Patent Publication No. 2005-327207 discloses a conventional vehicle mounting an engine body of an internal combustion engine at a front of a vehicle and mounting a carbon dioxide recovery device at a back of the vehicle.

SUMMARY

However, if a carbon dioxide recovery device is heated by heat from a heat source, the amount of carbon dioxide which can be recovered tends to decrease. In a vehicle, there are for example a catalyst device, battery, and various other heat sources in addition to the engine body. For this reason, if mounting a carbon dioxide recovery device at a vehicle without considering the positional relationship with the various types of heat sources mounted in the vehicle, the amount of recovery of carbon dioxide is liable to fall.

The present disclosure was made focusing on such a problem point and has as its object to keep the amount of recovery of carbon dioxide from falling.

To solve this problem, a vehicle according to one aspect of the present disclosure comprises an internal combustion engine including an engine body and a catalyst device configured to purify exhaust discharged from the engine body and a carbon dioxide recovery device configured to recover carbon dioxide contained in the exhaust. Further, in the vehicle, the engine body, catalyst device, and carbon dioxide recovery device are mounted so that relationships X1>X2 and X2>X3 stand where a distance from a mounting position of the engine body to a mounting position of the carbon dioxide recovery device is X1, a distance from a mounting position of the catalyst device to the mounting position of the carbon dioxide recovery device is X2, and a distance from a mounting position of the engine body to a mounting position of the catalyst device is X3.

Further, a vehicle according to another aspect of the present disclosure comprises an internal combustion engine including an engine body, a catalyst device configured to purify exhaust discharged from the engine body, and a main muffler, a carbon dioxide recovery device configured to recover carbon dioxide contained in the exhaust, a rechargeable battery, and a fuel tank configured to store fuel supplied to the engine body. Further, the engine body is arranged in the engine compartment at the front of the vehicle, the catalyst device is arranged further to the vehicle back side than the engine body, the fuel tank is arranged further to the vehicle back side than the catalyst device and below the front seats arranged in the passenger compartment space, the battery is arranged further to the vehicle back side than the fuel tank and below the back seats arranged in the passenger compartment space, the main muffler is arranged further to the vehicle back side than the battery, the carbon dioxide recovery device is arranged further to the vehicle back side than the battery and above the main muffler, a distance from the engine body to the catalyst device is shorter than a distance from the catalyst device to the carbon dioxide recovery device, and a distance from the engine body to the battery is longer than a distance from the battery to the carbon dioxide recovery device.

According to these aspects of the present disclosure, the engine body, which is larger in amount of heat generation than the catalyst device among the various types of heat sources mounted in the vehicle, is arranged at a position farther from the carbon dioxide recovery device than the catalyst device, so the effect of the amount of heat received by the carbon dioxide recovery device from the engine body can be reduced. Further, the catalyst device is arranged at a position closer to the engine body than the carbon dioxide recovery device, so the effect of the amount of heat received by the carbon dioxide recovery device from the catalyst device can be reduced. That is, according to these aspects of the present disclosure, the parts are arranged considering the positional relationship between the various types of heat sources mounted in the vehicle and the carbon dioxide recovery device, so it is possible to keep the amount of recovery of carbon dioxide from falling.

DESCRIPTION OF EMBODIMENTS

Figure 1:
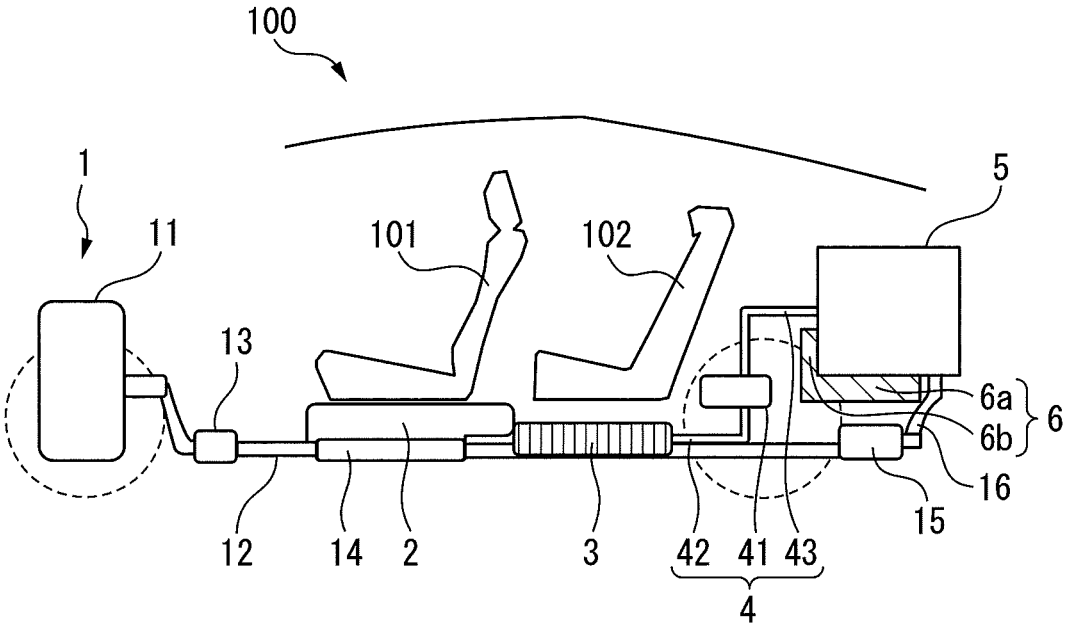
FIG. 1 is a schematic lateral view of a vehicle according to a first embodiment of the present disclosure.

Below, referring to the drawings, embodiments of the present disclosure will be explained in detail. Note that, in the following explanation, similar component elements will be assigned the same reference signs.

First Embodiment

Figure 2:
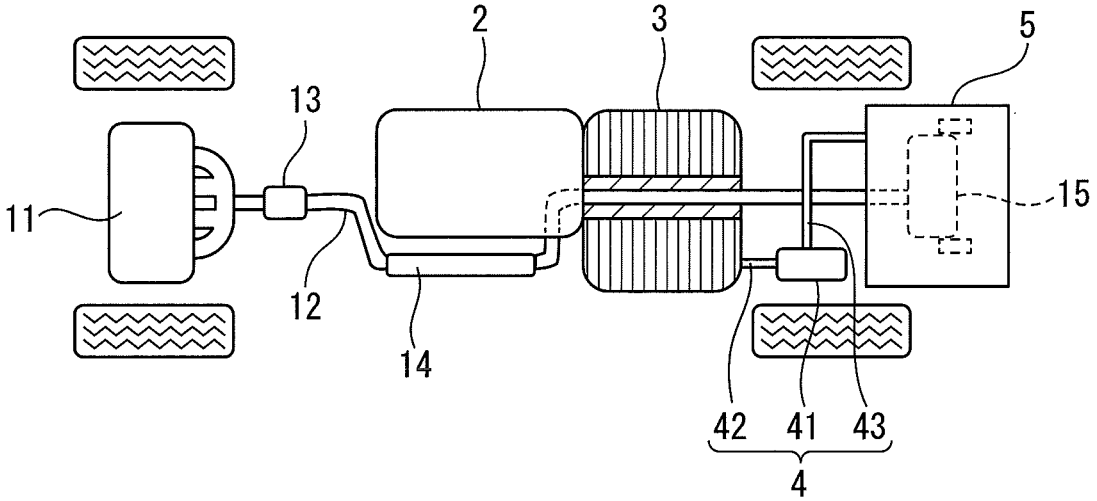
FIG. 2 is a schematic plan view of a vehicle according to the first embodiment of the present disclosure.

FIG. 1 and FIG. 2 are a schematic lateral view and schematic plan view of a vehicle 100 according to one embodiment of the present disclosure and views showing the positional relationships of main component parts including various types of heat sources etc. mounted in the vehicle 100.

As shown in FIG. 1 and FIG. 2, the vehicle 100 according to the present embodiment is provided with an internal combustion engine 1, fuel tank 2, battery 3, cooling device 4, and carbon dioxide recovery device 5.

The internal combustion engine 1 is provided with an engine body 11 mounted in an engine compartment formed at a front of the vehicle (left sides of FIG. 1 and FIG. 2), an exhaust pipe 12 extending from the engine body 11 to the back of the vehicle (left sides of FIG. 1 and FIG. 2) below an underbody (not shown) of the vehicle 100 (bottom side of FIG. 1 and FIG. 2) in the front-back direction of the vehicle, a catalyst device 13 provided at the exhaust pipe 12, a sub muffler 14, and a main muffler 15.

The engine body 11 makes the fuel supplied from the fuel tank 2 burn inside it to cause the generation of a drive force for driving the vehicle 100.

The catalyst device 13 is a device for purifying the exhaust, then discharging it to the outside air and is comprised of various types of catalysts removing harmful substances in the exhaust supported in a carrier (for example, is a three-way catalyst). In the present embodiment, the catalyst device 13 is provided at the exhaust pipe 12 so as to be positioned further to the vehicle back side than the engine body 11.

The sub muffler 14 and main muffler 15 are respectively devices for lowering the temperature and pressure of the exhaust flowing through the exhaust pipe 12 to reduce exhaust noise. In the present embodiment, the sub muffler 14 is provided at the exhaust pipe 12 so as to be positioned further to the vehicle back side than the catalyst device 13, while the main muffler 15 is provided at the exhaust pipe 12 so as to be positioned further to the vehicle back side than the sub muffler 14.

The fuel tank 2 stores the fuel to be supplied to the engine body 11. The fuel tank 2 is arranged below the underbody between the catalyst device 13 and the carbon dioxide recovery device 5. In the present embodiment, the fuel tank 2 is generally arranged below the front seats 101 provided in the passenger compartment space of the vehicle 100.

The battery 3, for example, is a nickel cadmium storage battery, a lithium hydrogen storage battery, and lithium ion battery, or other rechargeable secondary battery. The electric power charged at the battery 3 is, for example, supplied to a drive motor (not shown) for generating drive force for driving the vehicle 100. The battery 3 is arranged below the underbody between the catalyst device 13 and the carbon dioxide recovery device 5. In the present embodiment, the battery 3 is arranged further to the vehicle back side than the fuel tank 2 and generally is arranged below the back seats 102 provided in the passenger compartment space of the vehicle 100.

Figure 3:
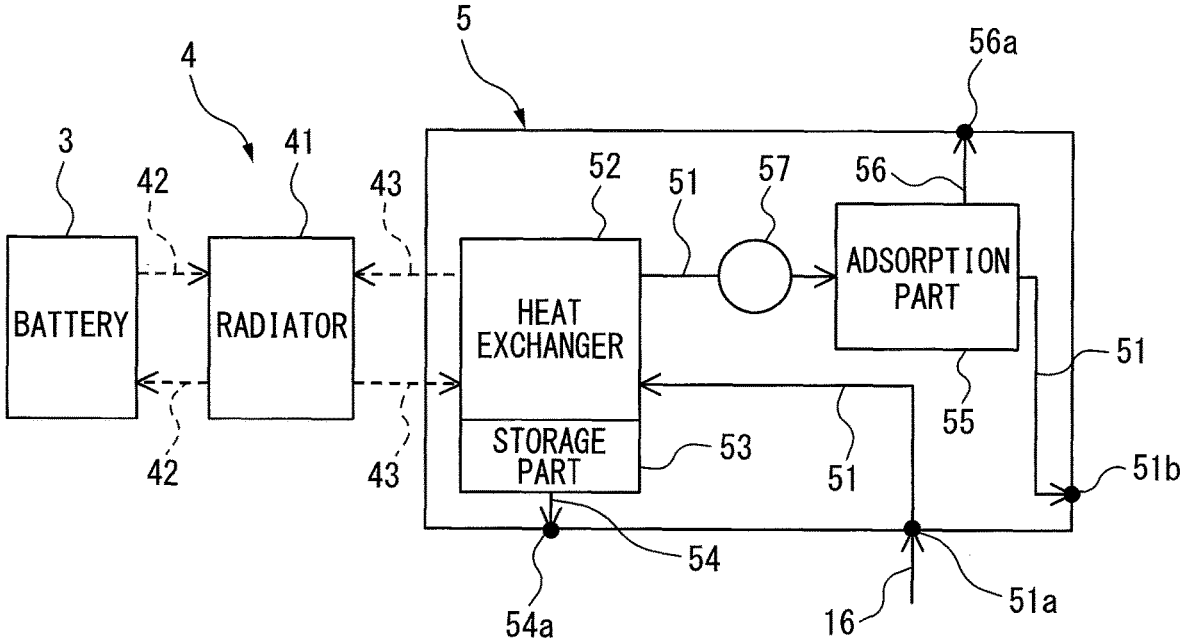
FIG. 3 is a schematic view the configuration of a carbon dioxide recovery device according to the first embodiment of the present disclosure.

The cooling device 4 is a device for cooling the battery 3 and carbon dioxide recovery device 5 (more specifically, exhaust introduced to the carbon dioxide recovery device 5) and is provided with a radiator 41, first cooling water circulation passage 42, and second cooling water circulation passage 43. Note that, in FIG. 1 and FIG. 2, to prevent complication of the drawings, the cooling device 4 is drawn streamlined, but FIG. 3 shows a more detailed configuration of the cooling device 4.

The radiator 41 is a heat exchanger provided with a cooling water introduction part, a core part, and a cooling water outlet part and is configured so as to be able to cool the high temperature cooling water introduced from the cooling water introduction part by heat exchange at the core part with for example the air or other low temperature gas and thereby discharge it from the cooling water outlet part. The radiator 41 is arranged at a suitable position between the battery 3 and the carbon dioxide recovery device 5.

The first cooling water circulation passage 42 is a passage for supplying the cooling water discharged from the radiator 41 to the battery 3 side so as to cool the battery 3, then returning it to the radiator 41 to make it recirculate. On the other hand, the second cooling water circulation passage 43 is a passage for supplying the cooling water discharged from the radiator 41 to the carbon dioxide recovery device 5 side so as to cool the exhaust introduced to the carbon dioxide recovery device 5, then returning it to the radiator 41 to make it recirculate.

The first cooling water circulation passage 42 and the second cooling water circulation passage 43 are respectively connected at single ends to the cooling water introduction part of the radiator 41 and connected at the other ends to the cooling water outlet part of the radiator 41. In this way, in the present embodiment, the cooling water and the radiator 41 are used in common to streamline the cooling device 4.

The carbon dioxide recovery device 5 is a device for recovering carbon dioxide in exhaust mainly discharged from the engine body 11. In the present embodiment, the carbon dioxide recovery device 5 is stored in luggage space at the back of the vehicle and is arranged generally above the main muffler 15.

Note that, since the carbon dioxide recovery device 5 is a heavy object, the storage position of the carbon dioxide recovery device 5 in the luggage space is preferably below it as much as possible. Preferably, the position of at least the top end face of the carbon dioxide recovery device 5 is preferably made one becoming lower than the position of top end faces of head rests of the front seats 101 and the back seats 102 provided in the passenger compartment space. Due to this, it is possible to keep the vehicle running performance from deteriorating and keep the carbon dioxide recovery device 5 from ending up dropping onto the heads of the passengers in the passenger compartment space at the time of vehicle collision.

At the bottom surface of the carbon dioxide recovery device 5, a heat insulating material **6*a* is provided for inhibiting the rise of temperature of the carbon dioxide recovery device 5 by the heat of exhaust from the main muffler 15 etc. Further, at part of the front surface of the carbon dioxide recovery device 5 as well, in the same way, a heat insulating material 6*b* is provided for suppressing a rise in temperature of the carbon dioxide recovery device 5 due to the heat from the various types of heat sources arranged further to the vehicle front side than the carbon dioxide recovery device 5 (in the present embodiment, the internal combustion engine 1, catalyst device 13, and battery 3). In the present embodiment, the heat insulating material 6*a* and heat insulating material 6*b* are made an integral heat insulating material 6**, but they may also be separate members.

The method of recovery of the carbon dioxide in the exhaust by the carbon dioxide recovery device 5 is not particularly limited, but, for example, the physical adsorption method or physical absorption method, chemical absorption method, cryogenic separation method, etc. may be mentioned.

The physical adsorption method is a method of bringing, for example, activated carbon, zeolite, or another solid adsorbent into contact with the exhaust to make the carbon dioxide be adsorbed at the solid adsorbent and heating (or reducing the pressure of) this to make the carbon dioxide desorb from the solid adsorbent for recovery.

The physical absorption method is a method of bringing an absorption solution able to dissolve carbon dioxide (for example methanol or ethanol) into contact with the exhaust to physically make the carbon dioxide be absorbed by the absorption solution under a high pressure and low temperature and heating (or reducing the pressure of) this to recover carbon dioxide from the absorption solution.

The chemical absorption method is a method of bringing an absorption solution able to selectively dissolve carbon dioxide (for example amine) into contact with the exhaust to make the carbon dioxide be absorbed by the absorption solution and heating this to cause carbon dioxide to dissociate from the absorption solution.

The cryogenic separation method is a method of compressing and cooling the exhaust to liquefy the carbon dioxide and selectively distilling the liquefied carbon dioxide to thereby recover the carbon dioxide.

In the present embodiment, as the method of recovery of the carbon dioxide in the exhaust, the physical adsorption method is employed. The carbon dioxide recovery device 5 is configured so as to make the zeolite of the solid adsorbent adsorb the carbon dioxide in the exhaust and be able to recover the carbon dioxide.

FIG. 3 is a schematic view of the configuration of the carbon dioxide recovery device 5 according to the present embodiment.

As shown in FIG. 3, the carbon dioxide recovery device 5 is provided with a gas introduction port 51*a*, gas discharge port 51*b*, gas circulation passage 51 connecting the gas introduction port 51*a* and gas discharge port 51*b*, heat exchanger 52 and adsorption part 55 arranged on the gas circulation passage 51, storage part 53, liquid discharge port 54*a*, liquid circulation passage 54 connecting the storage part 53 and liquid discharge port 54*a*, carbon dioxide takeout port 56*a*, recovery passage 56 connecting the adsorption part 55 and carbon dioxide takeout port 56*a*, and flowmeter 57.

The gas introduction port 51*a* is an inlet for introducing gas containing carbon dioxide to the gas circulation passage 51 inside the carbon dioxide recovery device 5. In the present embodiment, the gas introduction port 51*a* is connected through the connecting pipe 16 to the exhaust pipe 12 near the outlet side of the main muffler 15 so as to be able to introduce the exhaust having passed through the main muffler 15 from the gas introduction port 51*a* to the gas circulation passage 51. The exhaust introduced from the gas introduction port 51*a* to the gas circulation passage 51 flows through the gas circulation passage 51 and finally is discharged from the gas discharge port 51*b*.

The heat exchanger 52 is connected to the gas circulation passage 51 and second cooling water circulation passage 43 and is configured to exchange heat between the exhaust flowing through the gas circulation passage 51 and the cooling water flowing through the second cooling water circulation passage 43 to cool the exhaust flowing through the gas circulation passage 51, that is, the exhaust introduced to the inside of the carbon dioxide recovery device 5.

The storage part 53 stores the condensed water produced by cooling exhaust at the heat exchanger 52. The condensed water inside the storage part 53 is discharged through the fluid circulation passage 54 from the liquid discharge port 54*a* to the outside of the carbon dioxide recovery device 5.

The adsorption part 55 is connected to the gas circulation passage 51 at the downstream side from the heat exchanger 52 so as to enable the exhaust cooled by the heat exchanger 52 to be introduced to the inside. The adsorption part 55 has zeolite as a solid adsorbent inside it and adsorbs the carbon dioxide in the exhaust introduced through the gas circulation passage 51 to the inside of the adsorption part 55. The exhaust reduced in concentration of carbon dioxide due to adsorption of carbon dioxide by the adsorption part 55 flows through the gas circulation passage 51 at the downstream side from the adsorption part 55 and is discharged from the gas discharge port 51*b* to the outside air.

The recovery passage 56 is a passage for recovering the carbon dioxide adsorbed at the solid absorbent of the adsorption part 55 from the carbon dioxide takeout port 56*a*. In the present embodiment, the adsorption part 55 is heated through the recovery passage 56 while reducing the pressure of the adsorption part 55 to thereby make the carbon dioxide adsorbed at the solid absorbent desorb from the solid absorbent and suck out the desorbed carbon dioxide through the recovery passage 56 from the adsorption part 55 and recover it from the carbon dioxide takeout port 56*a*. Note that, in accordance with need, it is also possible to provide an on-off valve at the recovery passage 56 and open the on-off valve only at the time of recovery of the carbon dioxide.

The flowmeter 57 is provided in the gas circulation passage 51 between the heat exchanger 52 and the adsorption part 55 and measures the flow rate of the exhaust introduced to the adsorption part 55. By measuring the flow rate of exhaust by the flowmeter 57 in this way, for example, it is possible to estimate the amount of carbon dioxide adsorbed at the adsorption part 55.

In this regard, even if adopting one of the above-mentioned methods as the method for recovery of carbon dioxide, the carbon dioxide recovery device 5 is liable to be reduced in amount of carbon dioxide which it can recover if, for example, being heated by receiving heat from the heat sources. This is because in the case of the physical adsorption method or physical absorption method or the chemical absorption method, the more the carbon dioxide recovery device 5 is heated and the temperature of the adsorption part 55 (or absorption part) rises, the more dominant the desorption or dissociation of carbon dioxide at the adsorption part 55 (or absorption part). Further, in the case of the cryogenic separation method, the more the carbon dioxide recovery device 5 is heated and the temperature inside it rises, the more the liquefaction of the carbon dioxide ends up being inhibited.

Therefore, when mounting a carbon dioxide recovery device 5 in a vehicle 100 having an engine body 11, catalyst device 13, battery 3, or other plurality of heat sources and limited in mounting space, if ending up mounting the carbon dioxide recovery device 5 without considering the positional relationships with the heat sources, the amount of heat received from the heat sources ends up becoming larger. This being so, even if making the vehicle 100 run under the same running conditions, if the amount of heat received from the heat sources is great, compared to if it is small, the amount of recovery (recovery rate) of the carbon dioxide during one trip is liable to fall.

For this reason, when mounting the carbon dioxide recovery device 5 at the vehicle 100, it is preferable to optimize the positional relationships of the heat sources and the carbon dioxide recovery device 5 and reduce the amount of heat received from the heat sources as much as possible.

Figure 4:
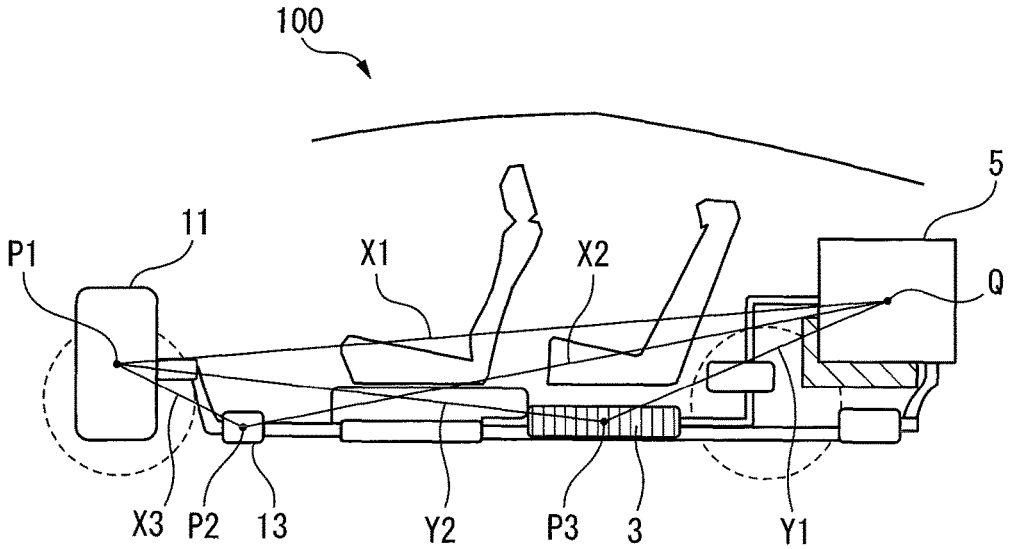
FIG. 4 is a view explaining positional relationships among an engine body, catalyst device, battery, and carbon dioxide recovery device.

Therefore, in the present embodiment, the engine body 11, catalyst device 13, battery 3, and carbon dioxide recovery device 5 are arranged at the positions explained above referring to FIG. 1 and FIG. 2 so that the following relationships explained referring to FIG. 4 stand.

As shown in FIG. 4, the mounting positions of the heat sources of the engine body 11, catalyst device 13, and battery 3 are made P1, P2, and P3 and the mounting position of the carbon dioxide recovery device 5 is made Q. The mounting positions P1, P2, P3, and Q, for example, can be made center of gravity positions of the parts.

Further, the parts are arranged so that the relationships of X1>X2 and X2>X3 stand where the distance from the mounting position P1 of the engine body 11 to the mounting position Q of the carbon dioxide recovery device 5 is X1, the distance from the mounting position P2 of the catalyst device 13 to the mounting position Q of the carbon dioxide recovery device 5 is X2, and the distance from the mounting position P1 of the engine body 11 to the mounting position P2 of the catalyst device 13 is X3. The distances X1, X2, and X3, for example, can be made lengths of line segments connecting the mounting positions.

In this way, in the present embodiment, the engine body 11 is arranged at a position farther from the carbon dioxide recovery device 5 than the catalyst device 13 (X1>X2) so as to arrange the engine body 11 with the greatest amount of heat generation among the heat sources at the position farthest from the carbon dioxide recovery device 5. Due to this, it is possible to reduce the amount of heat received from the engine body 11 and reduce the overall amount of heat received from the heat sources, so it is possible to keep the temperature of the carbon dioxide recovery device 5 from rising. Accordingly, it is possible to keep the amount of recovery (recovery rate) of carbon dioxide by the carbon dioxide recovery device 5 from falling.

Further, when arranging the engine body 11 at a position farther from the carbon dioxide recovery device 5 than the catalyst device 13, the catalyst device 13 is arranged between the engine body 11 and the carbon dioxide recovery device 5, but at that time, the catalyst device 13 is arranged at a position closer to the engine body 11 than the carbon dioxide recovery device 5 (X2>X3). Due to this, it is possible to reduce the amount of heat received from the catalyst device 13 and further keep the temperature of the carbon dioxide recovery device 5 from rising. Further, by making the catalyst device 13 close to the engine body 11 with the greatest amount of heat generation among the heat sources, it is possible to more easily raise the temperature of the catalyst device 13 at the time of engine warm-up and hold the temperature of the catalyst device 13 after engine warm-up.

Further, in the present embodiment, the parts are arranged so that the relationship of Y2>Y1 stands where the distance from the mounting position P3 of the battery 3 to the mounting position Q of the carbon dioxide recovery device 5 is Y1 and the distance from the mounting position P1 of the engine body 11 to the mounting position P3 of the battery 3 is Y2. The distances Y1 and Y2 can also be made the lengths of the line segments connecting these mounting positions.

In this way, in the present embodiment, the battery 3 with a relatively small amount of heat generation among the heat sources and with a temperature range at the time of heat generation close to the temperature range of the heat exchanger 52 when exhaust is introduced into the heat exchanger 52 of the carbon dioxide recovery device 5 is arranged at a position closer to the carbon dioxide recovery device 5 than the engine body 11 to arrange the battery 3 and the carbon dioxide recovery device 5 at relatively close positions. Due to this, it is possible to use in common the cooling water for cooling the battery 3 and carbon dioxide recovery device 5 and the radiator 41 for cooling the cooling water and shorten the lengths of the circulation passages 42, 43 for guiding cooling water to the battery 3 and carbon dioxide recovery device 5. Accordingly, it is possible to streamline the cooling device 4.

Further, in the present embodiment, the parts are arranged so that the relationship of X2>Y1 stands.

In this way, in the present embodiment, the catalyst device 13 is arranged at a position farther from the carbon dioxide recovery device 5 than the battery 3. Due to this, it is possible to shorten the amount of heat received from the catalyst device 13 with a greater amount of heat generation than the battery 3 to keep the temperature of the carbon dioxide recovery device 5 from rising.

The vehicle 100 according to the present embodiment explained above is provided with an internal combustion engine 1 including a catalyst device 13 purifying the exhaust discharged from the engine body 11 and the engine body 11 and a carbon dioxide recovery device 5 recovering the carbon dioxide contained in the exhaust. Further, in the vehicle 100, the engine body 11, catalyst device 13, and carbon dioxide recovery device 5 are mounted so that the relationships of X1>X2 and X2>X3 stand where the distance from the mounting position P1 of the engine body 11 to the mounting position Q of the carbon dioxide recovery device 5 is X1, the distance from the mounting position P2 of the catalyst device 13 to the mounting position Q of the carbon dioxide recovery device 5 is X2, and the distance from the mounting position P1 of the engine body 11 to the mounting position P2 of the catalyst device 13 is X3.

Due to this, among the heat sources, the engine body 11 with a greater amount of generation of heat than the catalyst device 13 can be arranged at a position further from the carbon dioxide recovery device 5 than the catalyst device 13. For this reason, it is possible to reduce the overall amount of heat received from the heat sources, so it is possible to keep the temperature of the carbon dioxide recovery device 5 from rising. Accordingly, it is possible to keep the amount of recovery of carbon dioxide by the carbon dioxide recovery device 5 (recovery rate) from falling.

Further, in arranging the catalyst device 13 between the engine body 11 and the carbon dioxide recovery device 5, by arranging the catalyst device 13 at a position closer to the engine body 11 than the carbon dioxide recovery device 5, it is possible to reduce the amount of heat received from the catalyst device 13, so it is possible to further keep the temperature of the carbon dioxide recovery device 5 from rising. Further, by bringing the catalyst device 13 close to the engine body 11, it is possible to easily raise the temperature of the catalyst device 13 at the time of engine warm-up and hold the temperature of the catalyst device 13 after engine warm-up.

Further, the vehicle 100 according to the present embodiment is further provided with a rechargeable battery 3 and a cooling device 4 cooling the battery 3 and carbon dioxide recovery device 5. At the vehicle 100, the engine body 11, battery 3, and carbon dioxide recovery device 5 are mounted so that the relationship of Y2>Y1 further stands where the distance from the mounting position P3 of the battery 3 to the mounting position Q of the carbon dioxide recovery device 5 is Y1 and the distance from the mounting position P1 of the engine body 11 to the mounting position P3 of the battery 3 is Y2. Further, the cooling device 4 is configured to use in common the cooling water (refrigerant) for cooling the battery 3 and carbon dioxide recovery device 5 and the radiator 41 cooling the cooling water.

In this way, by arranging the battery 3 with relatively little amount of heat generation even among the heat sources at a position closer to the carbon dioxide recovery device 5 than the engine body 11, when using in common the cooling water (refrigerant) for cooling the battery 3 and carbon dioxide recovery device 5 and the radiator 41 cooling the cooling water, using them in common becomes easier and the cooling device 4 can be streamlined.

Further, at the vehicle 100 according to the present embodiment, the catalyst device 13. battery 3, and carbon dioxide recovery device 5 are mounted so that the relationship of X2>Y1 further stands.

Due to this, it is possible to arrange the catalyst device 13 with the greater amount of heat generation than the battery 3 at a position farther from the carbon dioxide recovery device 5 than the battery 3 and further arrange the engine body 11 with the greater amount of heat generation than the catalyst device 13 at a position farther from the carbon dioxide recovery device 5 than the catalyst device 13. For this reason, it is possible to reduce the overall amount of heat received from the three heat sources, so it is possible to keep the temperature of the carbon dioxide recovery device 5 from rising. Accordingly, it is possible to keep the amount of recovery of carbon dioxide (recovery rate) by the carbon dioxide recovery device 5 from falling.

Further, in the present embodiment, the mounting position Q of the carbon dioxide recovery device 5 is made the back of the vehicle, for example, inside the luggage space. For this reason, for example, compared with when the mounting position Q of the carbon dioxide recovery device 5 was made below the underbody of the vehicle 100 etc., it is possible to improve the efficiency of the work of recovery of carbon dioxide from the recovery passage 56.

Further, the internal combustion engine 1 according to the present embodiment is further provided with the main muffler 15 reducing the noise of the exhaust discharged from the engine body 11 at the back of the vehicle. The mounting position Q of the carbon dioxide recovery device 5 is made above the main muffler 15. Exhaust flowing through the exhaust pipe 12 near the main muffler is introduced to the carbon dioxide recovery device 5.

For this reason, exhaust which has fallen in temperature in the process of flowing from the vehicle front side to the vehicle back side can be introduced into the carbon dioxide recovery device 5. Further, it is possible to shorten the length of the connecting pipe 16 connecting the exhaust pipe 12 and carbon dioxide recovery device 5 and otherwise easily introduce exhaust from the exhaust pipe 12 to the carbon dioxide recovery device 5.

Further, the vehicle 100 according to the present embodiment is further provided with a heat insulating material 6 arranged between the carbon dioxide recovery device 5 and the main muffler 15. For this reason, it is possible to keep the temperature of the carbon dioxide recovery device 5 from rising due to the heat of exhaust from the main muffler 15 etc.

Further, in the present embodiment, the carbon dioxide recovery device 5 is mounted in the vehicle 100 so that the height position of the top end becomes lower than the height positions of the top ends of the head rests of the seats arranged in the passenger compartment space. Due to this, at the time of vehicle collision, the carbon dioxide recovery device 5 can be kept from ending up dropping on to the heads of the passengers in the passenger compartment space.

Second Embodiment

Next, a second embodiment of the present disclosure will be explained. The present embodiment differs from the first embodiment on the point of provision of a partition plate 7 between the passenger compartment space and the space where the carbon dioxide recovery device 5 is arranged. Below, this point of difference will be focused on for the explanation.

As shown in the above-mentioned first embodiment, if the carbon dioxide recovery device 5 is stored in for example the luggage space at the back of the vehicle etc. and if the passenger compartment space and the space in which the carbon dioxide recovery device 5 is arranged are not completely separated, even if carbon dioxide leaks from the carbon dioxide recovery device 5, carbon dioxide is liable to end up invading the passenger compartment space.

Figure 5:
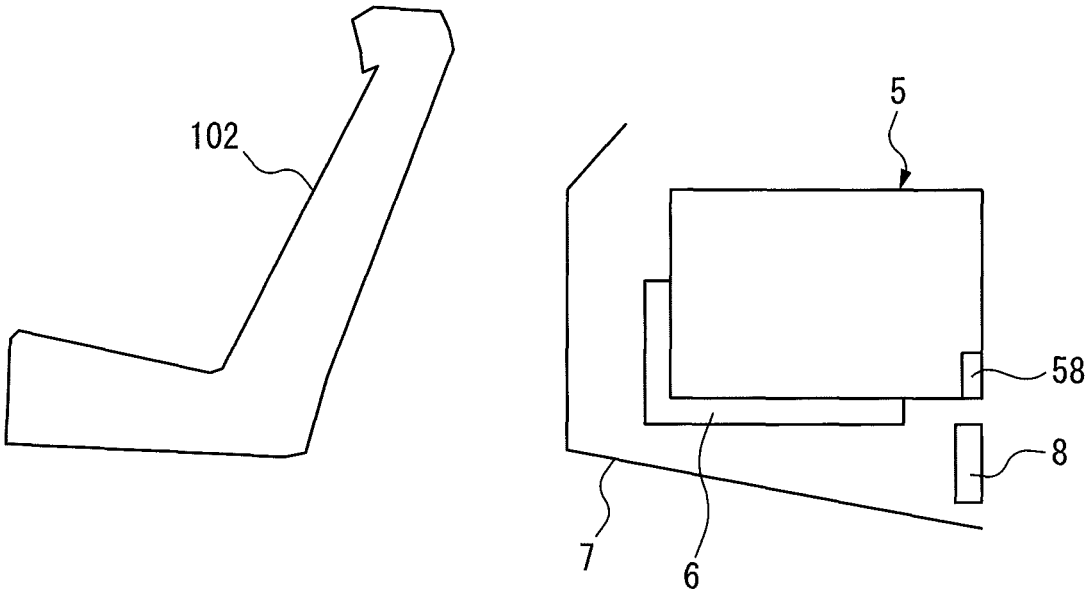
FIG. 5 is a schematic lateral view of a vehicle according to a second embodiment of the present disclosure provided with a partition plate between a passenger compartment space and luggage space.

Therefore, in the present embodiment, as shown in FIG. 5, between the passenger compartment space and luggage space, a partition plate 7 partitioning the passenger compartment space and luggage space is provided. Due to this, even if carbon dioxide leaks from the carbon dioxide recovery device 5, carbon dioxide can be kept from invading the passenger compartment space.

Further, in the present embodiment, this partition plate 7 is extended toward the back of the vehicle to below the carbon dioxide recovery device 5. Between the bottom surface of the carbon dioxide recovery device 5 and the partition plate 7 positioned below the carbon dioxide recovery device 5, a fan 8 is provided for discharging the gas in the space between them to the outside. Due to this, even if carbon dioxide leaks from the carbon dioxide recovery device 5, the fan 8 can be driven to thereby forcibly discharge the leaked carbon dioxide to the outside, so carbon dioxide can be kept from invading the passenger compartment space.

Further, in the present embodiment, the partition plate 7 positioned below the carbon dioxide recovery device 5 is tilted so that the interval from the bottom surface of the carbon dioxide recovery device 5 expands the further toward the vehicle back. Due to this, even if carbon dioxide leaks from the carbon dioxide recovery device 5, carbon dioxide, which is heavier than air, can be guided to the vehicle back side and easily discharged to the outside. Further, at the time of vehicle collision, it is possible to promote the heavy object of the carbon dioxide recovery device 5 dropping off to the bottom at the vehicle back side.

Further, in the present embodiment, a rupture disk 58 rupturing when the internal pressure of the carbon dioxide recovery device 5 becomes a predetermined pressure or more is provided at the vehicle back side and bottom side of the carbon dioxide recovery device 5. Due to this, even when the inside of the carbon dioxide recovery device 5 is filled with exhaust or carbon dioxide and the internal pressure increases, the rupture disk 58 ruptures so it is possible to efficiently discharge the exhaust of the carbon dioxide recovery device 5 or carbon dioxide, which is heavier than air, from the vehicle back side.

Above, embodiments of the present disclosure were explained, but the above embodiments only show some of the examples of application of the present disclosure. They are not meant to limit the technical scope of the present disclosure to the specific configurations of the above embodiments.

Figure 6:
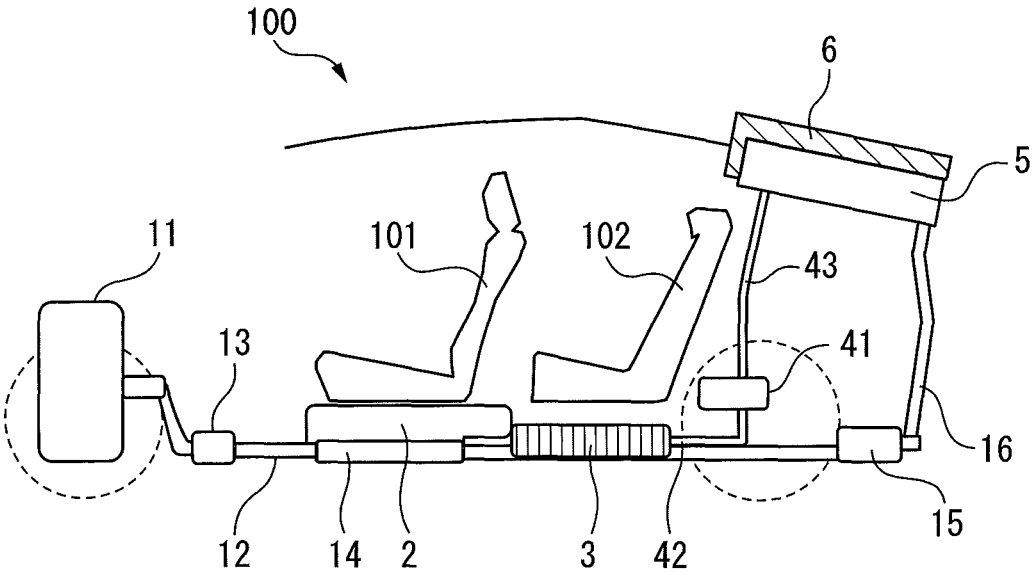
FIG. 6 is a schematic lateral view of a vehicle according to another embodiment of the present disclosure.
Figure 7:
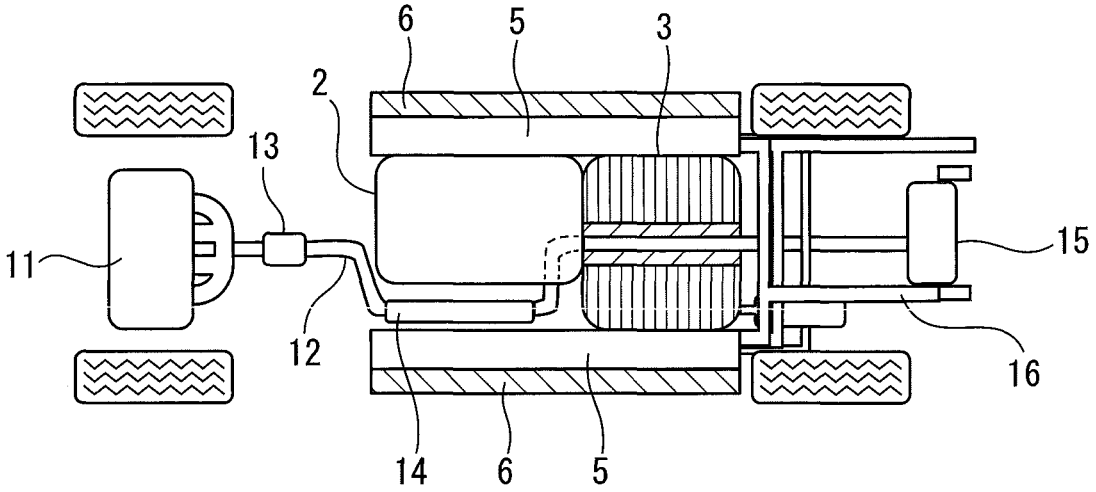
FIG. 7 is a schematic plan view of a vehicle according to another embodiment of the present disclosure.

For example, in the above embodiments, the carbon dioxide recovery device 5 had been stored in luggage space at the back of the vehicle, but it is not limited to this. For example as shown in the vehicle lateral view shown in FIG. 6, the carbon dioxide recovery device 5 may also be arranged for example at the top surface of the outside of the vehicle 100. Further, as shown in the plan view of the vehicle shown in FIG. 7, the carbon dioxide recovery device 5 may also be arranged below the passenger compartment space of the vehicle 100 and at the lateral surface of the vehicle 100.

Further, in the above embodiments, exhaust was introduced into the carbon dioxide recovery device 5 to recover the carbon dioxide in the exhaust, but the disclosure is not limited to this. For example, the gas circulation passage 51 may also be provided with a pump etc. to introduce air to the carbon dioxide recovery device 5 and enable recovery of carbon dioxide in the atmosphere.

Further, in the above embodiments, the carbon dioxide recovery device 5 was provided with the recovery passage 56 and the carbon dioxide adsorbed at the adsorption part 55 was recovered through the recovery passage 56 from the carbon dioxide takeout port 56*a*, but the disclosure is not limited to this. The carbon dioxide recovery device 5 may also be configured as a cartridge type enabling easy replacement of the adsorption part 55 so as to enable replacement with a new device when that the amount of carbon dioxide adsorbed at the adsorption part 55 becomes a certain level or more. In this case, the recovery passage 56 and the carbon dioxide takeout port 56*a* become unnecessary.

The invention claimed is:

1. A vehicle comprising:

an internal combustion engine including an engine body and a catalyst device configured to purify exhaust discharged from the engine body;

a carbon dioxide recovery device configured to recover carbon dioxide contained in the exhaust;

a rechargeable battery; and a cooling device configured to cool the battery and the carbon dioxide recovery device, wherein:

the engine body, catalyst device, and carbon dioxide recovery device are mounted such that X1>X2 and X2>X3, wherein X1, X2, and X3 being defined as follows:

a distance from a mounting position of the engine body to a mounting position of the carbon dioxide recovery device is X1, a distance from a mounting position of the catalyst device to the mounting position of the carbon dioxide recovery device is X2, and a distance from a mounting position of the engine body to a mounting position of the catalyst device is X3;

the engine body, battery, and carbon dioxide recovery device are mounted such that Y2>Y1, wherein Y1 and Y2 are defined as follows;

a distance from a mounting position of the battery to the mounting position of the carbon dioxide recovery device is Y1 and a distance from the mounting position of the engine body to the mounting position of the battery is Y2; and the cooling device is configured to use in common a refrigerant for respectively cooling the battery and the carbon dioxide recovery device and a radiator for cooling the refrigerant.

2. The vehicle according to claim 1, wherein the catalyst device, battery, and carbon dioxide recovery device are arranged such that X2>Y1.

3. A vehicle comprising:

an internal combustion engine including an engine body and a catalyst device configured to purify exhaust discharged from the engine body;

a carbon dioxide recovery device configured to recover carbon dioxide contained in the exhaust, wherein:

the engine body, catalyst device, and carbon dioxide recovery device are mounted such that X1>X2 and X2>X3, wherein X1, X2, and X3 being defined as follows:

a distance from a mounting position of the engine body to a mounting position of the carbon dioxide recovery device is X1, a distance from a mounting position of the catalyst device to the mounting position of the carbon dioxide recovery device is X2, and a distance from a mounting position of the engine body to a mounting position of the catalyst device is X3;

the mounting position of the carbon dioxide recovery device is further to a rear portion of the vehicle than a passenger compartment space;

the internal combustion engine further comprises a main muffler configured to reduce noise of exhaust discharged from the engine body;

the mounting position of the carbon dioxide recovery device is above the main muffler, and exhaust flowing through an exhaust pipe near an outlet of the main muffler is introduced to the carbon dioxide recovery device.

4. The vehicle according to claim 3, wherein a heat insulating material is arranged between the carbon dioxide recovery device and the main muffler.

5. A vehicle comprising:

an internal combustion engine including an engine body and a catalyst device configured to purify exhaust discharged from the engine body;

a carbon dioxide recovery device configured to recover carbon dioxide contained in the exhaust, wherein:

the engine body, catalyst device, and carbon dioxide recovery device are mounted such that X1>X2 and X2>X3, wherein X1, X2, and X3 being defined as follows:

a distance from a mounting position of the engine body to a mounting position of the carbon dioxide recovery device is X1, a distance from a mounting position of the catalyst device to the mounting position of the carbon dioxide recovery device is X2, and a distance from a mounting position of the engine body to a mounting position of the catalyst device is X3;

the mounting position of the carbon dioxide recovery device is a luggage space positioned further to a rear portion of the vehicle than a passenger compartment space, and the vehicle further comprises a partition plate configured to partition the passenger compartment space and the luggage space between the passenger compartment space and the luggage space.

6. The vehicle according to claim 5, wherein the partition plate extends toward the rear portion of the vehicle to below the carbon dioxide recovery device, a distance between a bottom surface of the carbon dioxide recovery device and the partition plate positioned below the carbon dioxide recovery device becomes larger the further toward the rear portion of the vehicle, and between the bottom surface of the carbon dioxide recovery device and the partition plate positioned below the carbon dioxide recovery device, a fan configured to discharge gas in the space between them to an outside is provided.

7. A vehicle comprising:

an internal combustion engine including an engine body and a catalyst device configured to purify exhaust discharged from the engine body;

a carbon dioxide recovery device configured to recover carbon dioxide contained in the exhaust, wherein:

the engine body, catalyst device, and carbon dioxide recovery device are mounted such that X1>X2 and X2>X3, wherein X1, X2, and X3 being defined as follows:

a distance from a mounting position of the engine body to a mounting position of the carbon dioxide recovery device is X1, a distance from a mounting position of the catalyst device to the mounting position of the carbon dioxide recovery device is X2, and a distance from a mounting position of the engine body to a mounting position of the catalyst device is X3;

the carbon dioxide recovery device is mounted so that a height position of its top end is below a height position of top ends of head rests of seats arranged in a passenger compartment space.

8. A vehicle comprising:

an internal combustion engine including an engine body, a catalyst device configured to purify exhaust discharged from the engine body, and a main muffler reducing noise of the exhaust;

a carbon dioxide recovery device configured to recover carbon dioxide contained in the exhaust;

a rechargeable battery; and a fuel tank configured to store fuel supplied to the engine body, wherein the engine body is arranged in an engine room at a front of the vehicle, the catalyst device is arranged further to a vehicle back side than the engine body, the fuel tank is arranged further to the vehicle back side than the catalyst device and below front seats arranged in a passenger compartment space, the battery is arranged further to the vehicle back side than the fuel tank and below back seats arranged in the passenger compartment space, the main muffler is arranged further to the vehicle back side than the battery, the carbon dioxide recovery device is arranged further to the vehicle back side than the battery and above the main muffler, a distance from the engine body to the catalyst device is shorter than a distance from the catalyst device to the carbon dioxide recovery device, and a distance from the engine body to the battery is longer than a distance from the battery to the carbon dioxide recovery device.

* * * * *